US009650807B2

(12) United States Patent
Helsley

(10) Patent No.: US 9,650,807 B2
(45) Date of Patent: May 16, 2017

(54) TOOL OPERATED CHANNEL LATCH

(71) Applicant: HARTWELL CORPORATION, Placentia, CA (US)

(72) Inventor: Thomas John Helsley, Placentia, CA (US)

(73) Assignee: Hartwell Corporation, Placentia, CA (US)

( * ) Notice: Subject to any disclaimer, the term of this patent is extended or adjusted under 35 U.S.C. 154(b) by 0 days.

(21) Appl. No.: 15/119,447

(22) PCT Filed: Feb. 18, 2015

(86) PCT No.: PCT/US2015/016388

§ 371 (c)(1),
(2) Date: Aug. 17, 2016

(87) PCT Pub. No.: WO2015/126950

PCT Pub. Date: Aug. 27, 2015

(65) Prior Publication Data

US 2017/0016248 A1 Jan. 19, 2017

Related U.S. Application Data

(60) Provisional application No. 61/941,288, filed on Feb. 18, 2014.

(51) Int. Cl.
*E05B 13/10* (2006.01)
*E05B 35/00* (2006.01)
(Continued)

(52) U.S. Cl.
CPC ..... *E05B 13/10* (2013.01); *E05B 35/008* (2013.01); *E05B 41/00* (2013.01); *E05B 63/06* (2013.01);
(Continued)

(58) Field of Classification Search
CPC .. E05B 15/0086; E05B 65/0817; E05B 13/10; E05B 41/00; E05B 63/06;
(Continued)

(56) References Cited

U.S. PATENT DOCUMENTS 2,710,214 A 6/1955 Mills
2,722,445 A 11/1955 Cudney
(Continued)

OTHER PUBLICATIONS

Search Report and Written Opinion issued in Int'l App. No. PCT/US2015/016388 (2015).
(Continued)

*Primary Examiner* — Lloyd Gall
(74) *Attorney, Agent, or Firm* — Barnes & Thornburg LLP

(57) ABSTRACT

The present disclosure includes a tool operated channel latch used to secure a panel against a structure. The latch includes a bracket which mounts to a movable panel and includes an actuating mechanism to open and close the latch. A bolt is pivotably retained relative to the bracket for engaging against the structure closed by the panel. A lock assembly is carried on the actuator to engage a link which is movably coupled with both the bolt and the actuator. The lock assembly includes extending portions to engage at least one corresponding opening of the link. The link provides an over center toggle condition to retain the latch in a locked position until intentionally actuated by an operator.

10 Claims, 4 Drawing Sheets

(51) Int. Cl.

| | |
|---|---|
| ***E05B 41/00*** | (2006.01) |
| ***E05B 63/06*** | (2006.01) |
| ***E05C 3/06*** | (2006.01) |
| *E05B 15/00* | (2006.01) |
| *E05B 65/08* | (2006.01) |
| *E05C 19/14* | (2006.01) |
| *E05C 3/08* | (2006.01) |

(52) U.S. Cl.
CPC ..... *E05C 3/06* (2013.01); *E05C 19/14* (2013.01); *E05B 15/0086* (2013.01); *E05B 65/0817* (2013.01); *E05C 3/08* (2013.01); *E05C 19/145* (2013.01); *Y10S 292/49* (2013.01); *Y10T 70/5761* (2015.04)

(58) Field of Classification Search
CPC ..... E05B 35/008; E05C 19/14; E05C 19/145; E05C 3/06; E05C 3/08; Y10S 292/49; Y10T 70/5761; Y10T 70/5792; Y10T 292/1089; Y10T 292/1092
USPC .... 70/73, 208, 215, 224; 292/113, 207, 210, 292/223, 226, 256.69, DIG. 31
See application file for complete search history.

(56) References Cited

U.S. PATENT DOCUMENTS

| | | | | |
|---|---|---|---|---|
| 3,070,395 | A | 12/1962 | Morriston et al. | |
| 3,194,595 | A | 7/1965 | Wheeler et al. | |
| 3,279,836 | A | 10/1966 | Swanson | |
| 4,069,696 | A | 1/1978 | Steinbach | |
| 4,307,905 | A | 12/1981 | Poe et al. | |
| 4,638,649 | A * | 1/1987 | Chao | E05B 65/5269 292/207 |
| 4,736,174 | A | 4/1988 | Castonguay et al. | |
| 4,743,052 | A | 5/1988 | Stammreich et al. | |
| 4,911,485 | A | 3/1990 | Wasilewski | |
| 4,925,221 | A | 5/1990 | Carmody et al. | |
| 4,934,164 | A | 6/1990 | Shew | |
| 5,201,557 | A * | 4/1993 | Schlack | E05B 5/00 292/161 |
| 5,257,839 | A * | 11/1993 | Nielsen | E05C 19/14 292/104 |
| 5,454,239 | A | 10/1995 | Esaki et al. | |
| 5,638,709 | A | 6/1997 | Clavin | |
| 5,765,883 | A | 6/1998 | Dessenberger et al. | |
| 5,984,382 | A * | 11/1999 | Bourne | B64D 29/06 292/113 |
| 6,174,007 | B1 * | 1/2001 | Schlack | E05B 5/00 292/336.3 |
| 6,513,841 | B1 | 2/2003 | Jackson | |
| 7,185,926 | B2 | 3/2007 | Helsley et al. | |
| 7,503,600 | B2 | 3/2009 | Hautala et al. | |
| 8,186,728 | B2 * | 5/2012 | Kopylov | E05C 19/14 292/113 |
| 8,356,844 | B2 * | 1/2013 | Baic | E05B 41/00 292/205 |
| 8,419,088 | B2 | 4/2013 | Baic et al. | |
| 8,544,900 | B2 | 10/2013 | Elbrecht et al. | |
| 8,720,237 | B2 | 5/2014 | Williams | |
| 9,169,678 | B2 | 10/2015 | Rozema | |
| 2002/0195827 | A1 | 12/2002 | Jackson et al. | |
| 2015/0184543 | A1 | 7/2015 | Fabre et al. | |
| 2015/0184544 | A1 | 7/2015 | Fabre et al. | |

OTHER PUBLICATIONS

Search Report and Written Opinion issued in Int'l App. No. PCT/US2015/049216 (2015).

* cited by examiner

TOOL OPERATED CHANNEL LATCH

CROSS REFERENCE TO RELATED APPLICATIONS

This application is a U.S. nationalization under 35 U.S.C. §371 of International Application No. PCT/US2015/016388, filed Feb. 18, 2015, which claims the benefit of priority under 35 U.S.C. §119(e) to U.S. Provisional Patent Application No. 61/941,288, filed Feb. 18, 2014. The disclosures set forth in the referenced applications are incorporated herein by reference in their entireties.

BACKGROUND

The following disclosure relates to a tool operated channel latch used to secure a panel against a structure. The latch includes a bracket which mounts to the movable panel and includes an actuating mechanism to open and close the latch. A bolt is pivotably retained relative to the bracket for engaging against the structure closed by the panel. A lock assembly is carried on the actuator to engage a link which is movably coupled with both the bolt and the actuator. The lock assembly includes extending portions to engage at least one corresponding opening of the link. The link provides an over center toggle condition to retain the latch in a locked position until intentionally actuated by an operator.

One of the issues with some channel latch systems is that the latch may require a tool and two hands to operate the latch. In this regard, some prior art latches require the use of a tool to unlock the latch and then a second tool to pry the latch into an open condition. Other latches include the use of a tool to unlock the latch and then a second hand to manipulate a trigger or an extending portion of the latch to actuate the latching mechanism.

Other prior art latch systems may have provided for conditions which might not be preferred under some circumstances. For example, a false positive latch condition could be produced by some prior art latch systems. This would be undesirable in some circumstances since it might be preferred to maintain the latch in only one of two states at a given time. Namely, state one fully locked without any question about the locked condition and state two fully unblocked without any question about the condition of the latch being unblocked. As such, it could be desirable to provide a latching system that provides an indication when the latch is fully locked and an indication when the latch is unlocked. These condition indicators will allow the operator of the latch to detect the condition to make sure that there is no false positive latching condition. In this regard, it may be desirable or necessary to have the fully locked position before the device or vehicle with the panel is moved so that the operator of the device knows the panel is in the closed condition. Similarly, when the panel is to be unblocked and opened, for example for purposes of maintenance, it could be desirable to know that the panel is in the unlocked condition.

It might also be desirable to provide a latching system which can be operated with a single hand and single tool. This would require the elimination of a second prying tool as might be found in some prior art latching systems. Additionally this might require the elimination of a trigger or using a tool in one hand and prying with a second hand which might also be found in some prior art latching systems.

This background information is provided to identify some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which.

Figure 1:
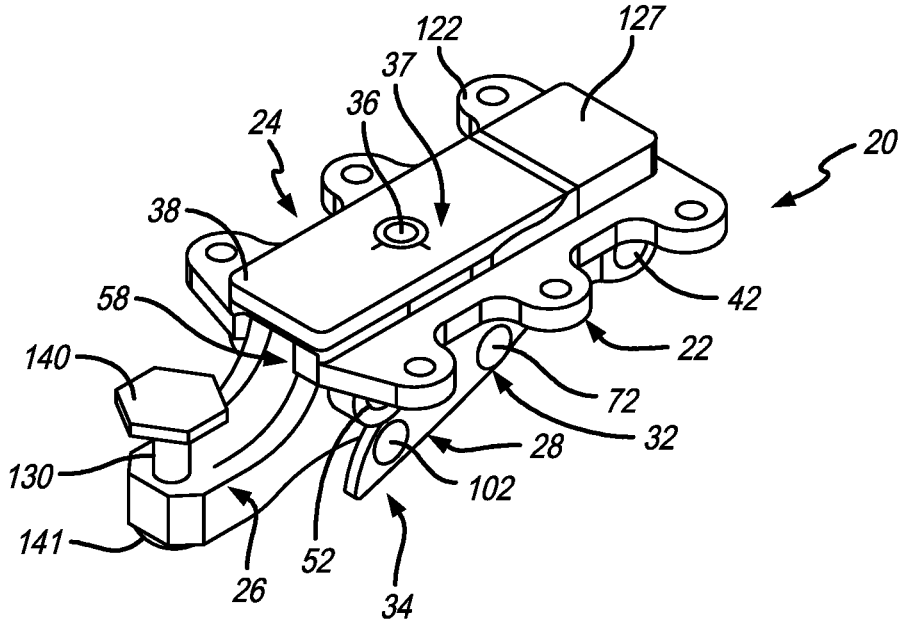
FIG. 1 is a perspective view of a channel latch assembly of the present disclosure showing a bracket for mounting to a panel, a bolt pivotably retained on the bracket and extending from the channel latch assembly in a locking condition, an actuator pivotably retained on the bracket, and a link operatively connecting a portion of the actuator to the bolt.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

FIG. 1 shows a perspective view of the latch assembly 20 including a bracket 22 which carries an actuator 24 and a bolt 26, both pivotably carried on the bracket 22 as described in greater detail below. At least one link 28, and the case of the illustrated embodiment two links 28, are pivotably connected at a first end 32 to a portion of the actuator 24 and at a second end 34 to a portion of the bolt 26. As will be described in greater detail below, the connection of the actuator 24 and bolt 26 with a link 28 provides an over center toggle condition when the four-bar linkage system is in the closed condition. In the closed condition a higher force on the bolt 26 pushes the latch 20 closed with a higher force. The over-center toggle of the link 28 and the connected actuator 24 redirects the forces acting on the bolt 26 to push it closed instead of open.

Figure 2:
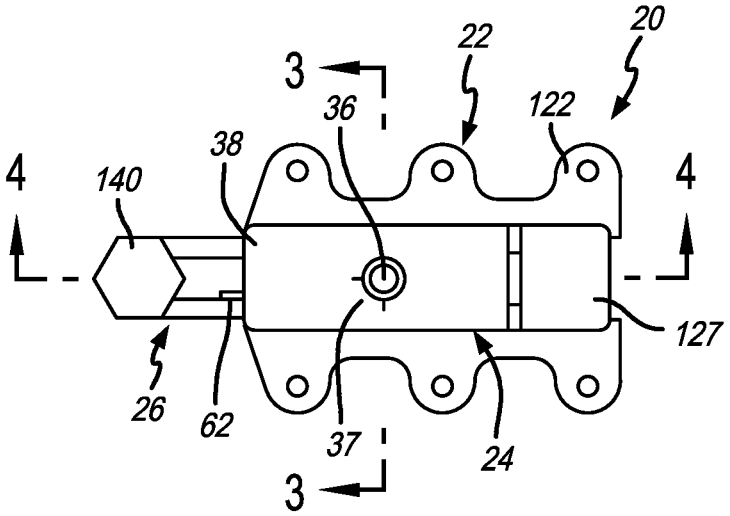
FIG. 2 is a top plan view of the latch assembly shown in FIG. 1 showing the bracket, a portion of the bolt extending from the bracket of the latch assembly, and an actuator positioned in the central channel of the latch assembly.
Figure 6:
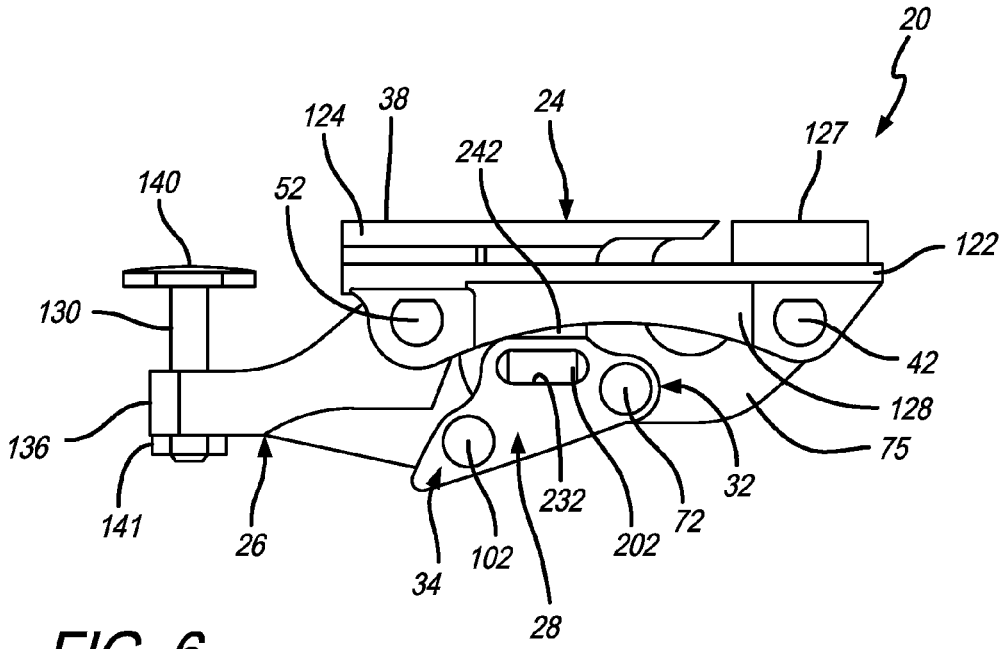
FIG. 6 is a side elevational view of the latch assembly in a closed condition.
Figure 7:
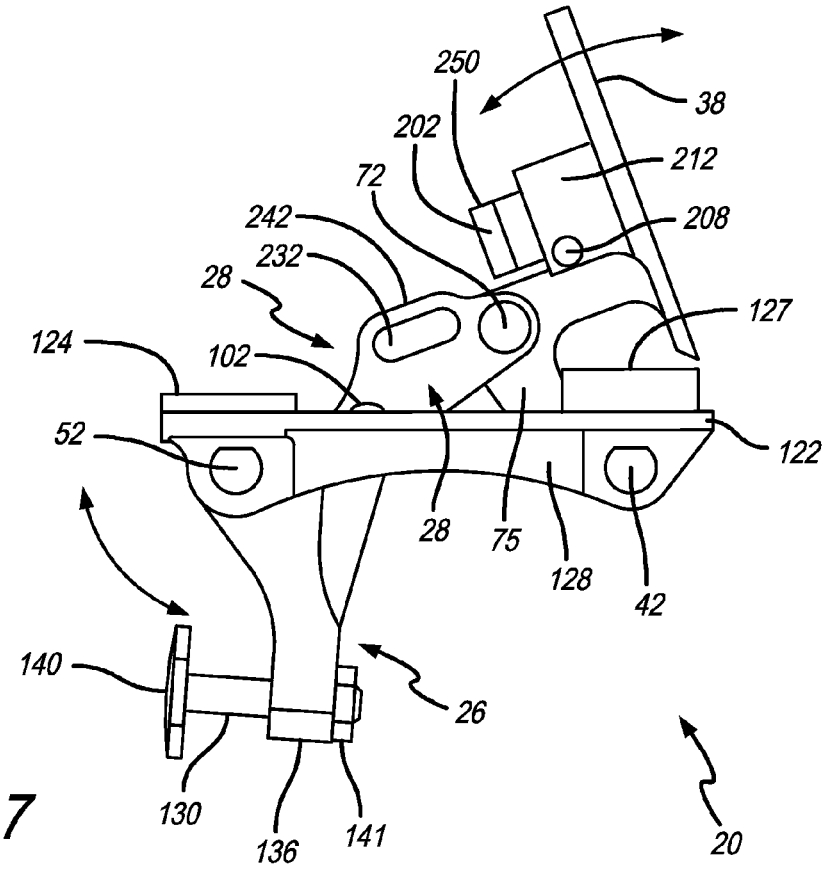
FIG. 7 is a side elevational view of the latch assembly in an unlocked and fully extended open condition.

FIG. 2 provides a plan view of the latch assembly 20 as described showing a tool receiving recess 36 on a face portion 38 of the actuator 24. The recess 36 receives a complementary tool head to facilitate rotation about an axis to position a lock assembly 200, described in greater detail below, in a "lock" or "unlock" position. The face of the actuator 38 also includes indicia 37 to indicate which direction the tool, while engaged in the recess, should be, rotated, leveraged, or moved to unlock or lock the lock assembly to "open" or "close" the latch assembly. The closed latch assembly is shown in FIG. 6 and the open latch assembly is shown in FIG. 7.

Figure 3:
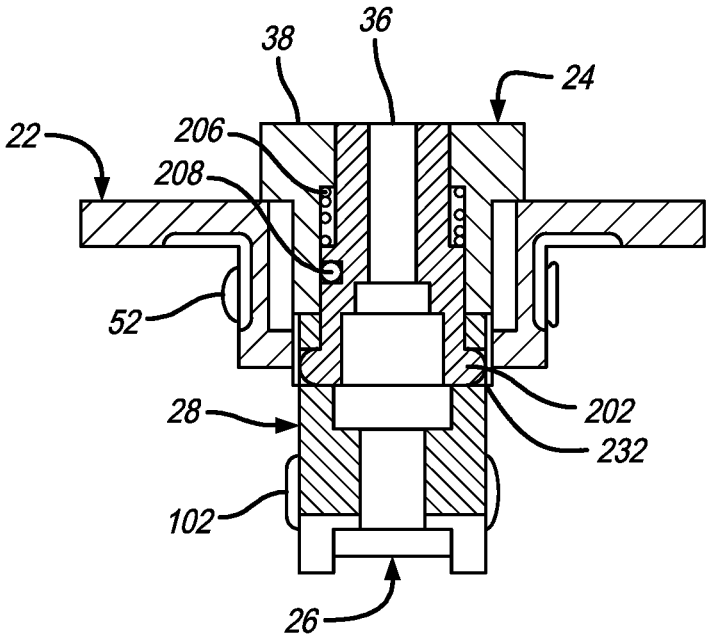
FIG. 3 is a cross sectional side elevational view taken along line 3-3 in FIG. 2 showing the relative relationships and connections of the described components of the latch assembly in a locked condition.
Figure 4:
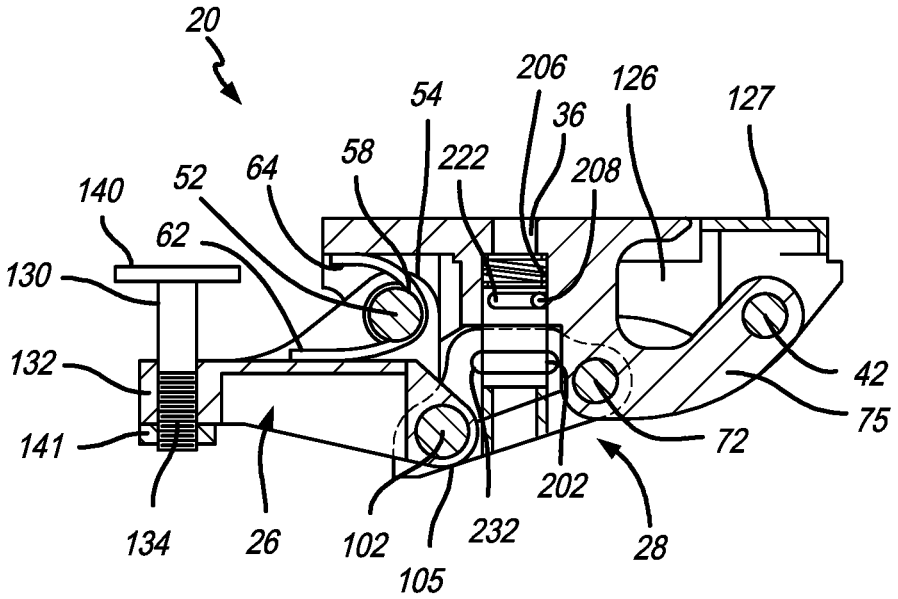
FIG. 4 is a cross sectional side elevational view taken along line 4-4 extending through a lock mechanism of the latch assembly showing the locked condition of an extending portion of the lock engaged with a corresponding opening in the link to facilitate an engagement of the lock with the link to prevent unintended opening of the latch assembly.
Figure 5:
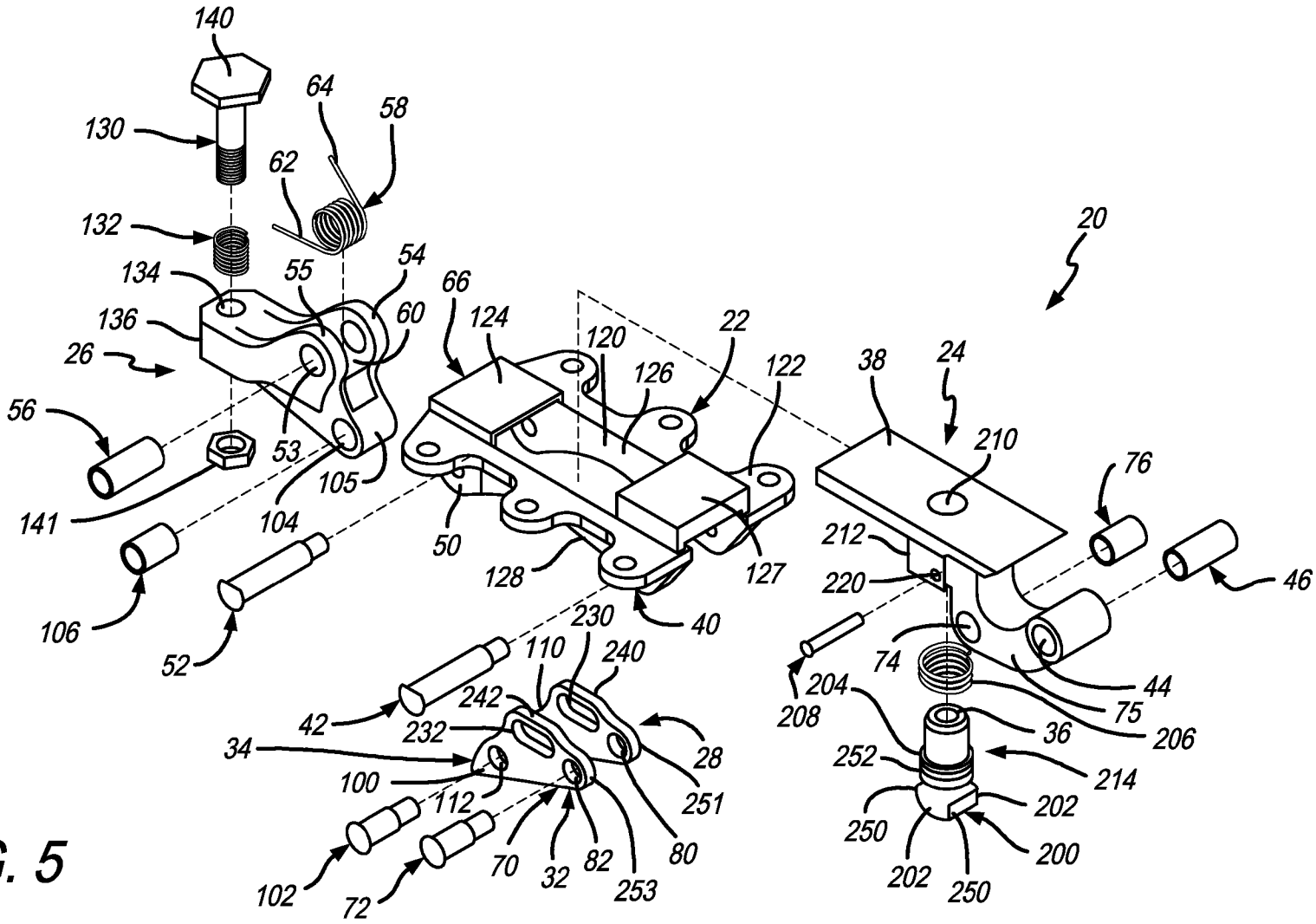
FIG. 5 is an exploded perspective view of the latch assembly showing the various components and relationships of the components for further relative description thereof.

Turning now to FIG. 3, a cross sectional side elevational view is shown as taken along line 3-3 in FIG. 2. Also, FIG. 4 is a cross sectional side elevational view taken along line 4-4 in FIG. 2. Description of these Figures is provided with additional reference to FIG. 5. The combination of these views helps to understand the configuration, orientation, structure, relationships, and function of the various components of the latch assembly 20. With reference to FIGS. 3-5, the bracket 22 includes a first passage 40 which receives a first rivet 42 extending there through. The first rivet 42 extending through the first passage 40 engages a corresponding head passage 44 of the actuator 24 and a bushing 46 retained therein. The assembly of the first passage 40 provides a pivot point of the actuator 24 relative to the bracket 22. Additionally, while a "passage" is mentioned it is recognized that the preferred embodiment of these passages is actually comprised of two holes in two spaced apart flanges 126, 128. However, the term "passage" is used generally to refer to the path or other alignment structure to retain the corresponding pivot components 42, 44, 46 in engagement with the bracket 22. Other engaging, retaining, and/or pivoting assemblies are similarly described with the understanding that the specific structures and functions as shown and described are intended to be broadly interpreted by way of illustration and not limitation.

In a similar manner, a second passage 50 is provided at an end of the bracket 22 spaced apart from the first passage 40. A second rivet 52 extends through the second passage 50 and engages a corresponding knuckle passage 53 in spaced apart knuckles 54, 55 on the bolt 26. A corresponding bushing 56 extends through the knuckle passage 53 for engagement by the second rivet 52. Additionally, a torsion spring 58 is positioned coaxially on the outside of the bushing 56 and rivet 52 combination in a recess 60 positioned generally between the spaced apart knuckles 54, 55. A bolt end 62 of the spring 58 abuts a corresponding surface of the bolt 26. A bracket end 64 of the spring 58 abuts a corresponding surface 66 on a bracket 22 portion 124. The torsion spring 58 engaged in this manner maintains the bolt 26 in a spring-loaded normally open condition with the spring 58 being compressed when the latch is closed.

The first end 32 of the link 28 includes a third passage 70. The third passage 70 receives the third rivet 72 extending there through to engage the corresponding arm passage 74 and bushing 76 retained on an arm portion 75 of the actuator 24. Spaced apart portions 80, 82 of the link 28 are positioned on each side of the arm 75 of the actuator 24.

The second end 34 of the link 28 includes a fourth passage 100. The fourth passage 100 includes a fourth rivet 102 which extends through a knee passage 104 spaced apart from the knuckle passage 53 on the bolt 26. A corresponding bushing 106 is carried in the knee passage 104 with the rivet 102 extending there through. Opposing portions 110, 112 of the second end 34 are positioned on opposite sides of the knee 105. This assembly including the fourth rivet 102 provides movement of the second end 34 of the link relative to the knee 105.

The face 38 of the actuator 24 extends through a channel opening 120 positioned generally centrally of the bracket 22. Extending flanges 122 provided along lateral sides of the bracket structure 22 provide mounting positions to attach the bracket 22 to the corresponding door panel in a manner well known in the art. Perpendicular supports 124, 127 extend between these flange portions to provide structure to the bracket 22. The first passage 40 and the second passage 50 are each provided in corresponding inwardly extending (relative to the panel to which the latch assembly is attached) flanges 126, 128 of the bracket 22.

The bolt 26 includes threaded adjustment screw 130 and a self-locking threaded insert 132 which are retained in a corresponding adjustment passage 134 on a tip 136 of the bolt 26. The adjustable screw 130 is retained in the threaded passage 134 to facilitate customized adjustment of the engaging surface 140 against an inside surface of the corresponding structure which is sealed by the panel to which the latching assembly 20 is attached. A jam nut 141 is provided on an opposite end of the passage 134 to receive the threaded shank of the screw 130 to retain the adjusted position of the screw and engaging surface 140.

A locking assembly 200 is provided and retained in cooperative relationship with the actuator 24. The locking assembly 200 includes protruding portions 202, a rotary surface 204, a torsion spring 206 and a retaining rivet 208. The locking assembly extends through the lock passage 210 formed in a body portion 212 of the actuator 24. The previously described tool receiving recess 36 is formed in a portion of the lock assembly body 214 which positions the recess 36 for receipt of a tool head through the passage 210.

The rivet 208 extends through a retaining passage 220 in the body portion 212 and engages a corresponding recess 222 which is defined at least along a partially annular portion 252 of the lock body 214. In this regard, the rivet 208 retention of the lock body 214 in the passage 210 while facilitating rotary motion of the lock body 214 within the passage 210.

A portion of the torsion spring 206 is engaged with the lock body 214 with an opposite end of the torsion spring engaged with an inside surface of the passage 210. This engagement of the spring 206 with these structures facilitates rotary spring motion of the lock body 214 in the passage 210. This spring-loaded lock body 214 returns the lock to the normally locked position when the latch is opened or closed. In the closed condition with the latch assembly in a latching configuration as in FIG. 6, this spring loaded arrangement retains the protruding portions 202 in corresponding openings 230, 232 in the link 28. As such, either in the locked condition or the open condition the protruding portions 202 of the lock body 214 are positioned for orientation in the locked position. This is useful in the closed position so that the protruding portions 202 are engaged in the corresponding openings 230, 232 in the link 28. The openings 230, 232 in the link 28 are positioned, on the link, and sized and dimensioned for engagement by a corresponding protruding portion 202. When the latch is unlocked and disengaged with the actuator 24 operated to disengage the bolt 26 from the structure the protruding portions 202 will abut the corresponding surfaces 240, 242 of the link 28 preventing inadvertent or incomplete locking and closing of the latch. This condition is shown in FIG. 7 with the protruding portions 202 rotated into the normally locked position by the torsion spring 206. As such, this blocking condition requires a tool to be inserted into the recess 36, rotation of the lock body 214 against the spring loaded torsion spring 206 at which point the actuator 24 may be positioned in the closed position with the bolt 26 engaging the structure. Once the tool is removed in this closed arrangement with the protruding portions 202 engaging the corresponding openings 230, 232.

As can be seen by the description and drawings as provided herein, the latch assembly 20 includes a lock assembly 200 which in an opened condition interacts with the link 28 to provide a "blocking" position described above preventing inadvertent partial closure or unlocked closure of the latch. This same locking assembly 200 also provides a positive locking condition to positively lock the latch in a closed position since the locking assembly requires positive operation to return the actuator to the closed position. If the locking assembly is not operated to position the sides 250 and the extensions 202 in between the inner opposing surfaces of the link 28 the face 38 of the actuator 24 will not close flush with the mounting bracket support potions 124, 127 and indicate an unlocked condition.

These discrete conditions prevent accidental false positive closures of the latch. Additionally, use of the tool in the recess 36 also may provide a lever or prying device for applying a prying force to disengage the actuator 24 from the closed condition once the latch is unlocked using the same tool. This eliminates the need for providing an additional larger pry opening in the latch assembly or an additional trigger element on the latch assembly. This facilitates a one hand operation, if necessary, to facilitate opening of the latch. This also facilitates a one hand operation of the latch, if necessary, to close the latch. Once the tool is inserted into the recess 36 it is used to rotate the body 214 to disengage or unlock the extensions 202 from the openings 232, 230 in the link 28. As the actuator is rotated upwardly away from the bracket to the open position, the opening force on the actuator 24 draws the link 28 along with it. As the link is displaced it draws the connected potion of the bolt 26 which pivots about the rivet 52 in the bracket 22. This drawing and pivoting motion rotates the bolt out of engagement with the structure to disengage the panel to which the latch is attached form the structure.

With reference to FIGS. 6 and 7, the described structures and functions can be seen in the closed position (FIG. 6) and the open position (FIG. 7). In the closed position the link 28 provides an over center toggle assembly at the pivot points of the third rivet 72 and fourth rivet 102 relative to the corresponding pivot points 74 and 104 of the actuator 24 and bolt 26, respectively. As also shown in FIG. 6, the protruding portion 202 is illustrated extending through the corresponding opening 232 of the link.

In the open position of FIG. 7, it can be seen that the bolt 26 pivots downwardly to disengage the surface 140 from the corresponding structure. This generally provides free and clear movement of the panel to which the latch assembly 20 is attached. As also shown in FIG. 7, the protruding portions 202 are rotated into the locked position after disengagement from the corresponding openings 232 in the link 28. It can be seen that the protruding portions 202 will abut the corresponding top surfaces 240, 242 of the link 28 to prevent accidental or unintended false positive closure of the latch in an unlocked condition. In other words, the latch balks since the protrusions 202 abut the surfaces 240, 242 and are prohibited from engaging the opening 232 unless a tool is actually used to rotate the lock to engage the protrusions 202 in the opening 232. With further reference to FIG. 5, it can be seen that flat portions 250 are positioned on faces in between the protruding portions 202 to facilitate passage of the lock body 214 between the spaced apart portions 251, 253 of the link 28 prior to rotating the protrusions 202 into engagement with the openings 230, 232 during the locking process.

The foregoing terms as well as other terms should be broadly interpreted throughout this application to include all known as well as all hereafter discovered versions, equivalents, variations and other forms of the abovementioned terms as well as other terms. The present disclosure is intended to be broadly interpreted and not limited.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A latch assembly comprising:

a bracket for use to attach the latch assembly to a structure;

a bolt pivotably carried on a portion of the bracket;

an actuator pivotably carried on a portion of the bracket and spaced from the bolt;

a link pivotably connected at a first end to the actuator and at a second end to the bolt, the link configured to rotate the bolt relative to the bracket during rotation of the actuator between a locked position and an unlocked position; and a lock assembly carried on the actuator and configured for selective rotation relative to the actuator;

wherein the link is formed to include an opening positioned, sized, and dimensioned for engagement by a corresponding protruding portion on the lock assembly when the actuator is in the locked position.

2. The latch assembly of claim 1, wherein the lock assembly includes a lock body carried by the actuator and a torsion spring coupled at one end to the lock body and at a second end to the actuator, the torsion spring configured to bias the lock body toward an engaged orientation relative to the actuator where the protruding portion is positioned to engage with the corresponding opening in the link when the actuator is in the locked position to selectively block movement of the actuator to the unlocked position and to engage with an outer surface of the link when the actuator is in the unlocked position to selectively block movement of the actuator to the locked position and provide an indicator of the latch being opened and preventing a false positive locking condition.

3. The latch assembly of claim 1, wherein the bolt is pivotable about a first pivot point relative to the bracket, the actuator is pivotable about a second pivot point relative to the bracket, the link is pivotable about a third pivot point relative to the bolt, and the link is pivotable about a fourth pivot point relative to the actuator, and wherein the link provides an over center condition at the third and fourth pivot points relative to the corresponding first and second pivot points when the actuator is in the locked position.

4. The latch assembly of claim 1, wherein the lock assembly includes a lock body and a retaining rivet, the retaining rivet coupled to the actuator, and the lock body formed to include a recess configured to engage with the retaining rivet to hold the lock body on the actuator and configured to allow the lock body to selectively rotate relative to the actuator.

5. The latch assembly of claim 1, wherein the actuator, link, and bolt are pivotally coupled together such that clockwise rotation of the actuator causes counterclockwise rotation of the bolt relative to the bracket.

6. A method of latching comprising:

providing a mounting bracket for attachment to a structure;

providing a bolt pivotally carried on a portion of the mounting bracket;

providing an actuator pivotally carried on the bracket and spaced from the bolt;

providing a link pivotably connected at a first end to the actuator and at a second end to the bolt, the link configured to rotate the bolt relative to the bracket during rotation of the actuator between a locked position and an unlocked position;

providing a lock assembly carried on the actuator; and engaging a protruding portion of the lock assembly with an opening in the link when the actuator is in the locked position to selectively hold the actuator in the locked position.

7. The method of latching of claim 6, wherein the lock assembly includes a lock body carried by the actuator and a torsion spring coupled at one end to the lock body and at a second end to the actuator, the torsion spring configured to bias the lock body toward an engaged orientation relative to the actuator where the protruding portion is positioned to engage with the corresponding opening in the link when the actuator is in the locked position to selectively block movement of the actuator to the unlocked position and to engage with an outer surface of the link when the actuator is in the unlocked position to selectively block movement of the actuator to the locked position and provide an indicator of the latch being opened and preventing a false positive locking condition.

8. The method of latching of claim 6, wherein the bolt is pivotable about a first pivot point relative to the bracket, the actuator is pivotable about a second pivot point relative to the bracket, the link is pivotable about a third pivot point relative to the bolt, and the link is pivotable about a fourth pivot point relative to the actuator, and wherein the link provides an over center condition at the third and fourth pivot points relative to the corresponding first and second pivot points when the actuator is in the locked position.

9. The method of latching of claim 6, wherein the lock assembly includes a lock body and a retaining rivet, the retaining rivet coupled to the actuator, and the lock body formed to include a recess configured to engage with the retaining rivet to hold the lock body on the actuator and configured to allow the lock body to selectively rotate relative to the actuator.

10. The method of latching of claim 6, wherein the actuator, link, and bolt are pivotally coupled together such that clockwise rotation of the actuator causes counterclockwise rotation of the bolt relative to the bracket.

* * * * *